US008336568B1

(12) United States Patent
Belden

(10) Patent No.: US 8,336,568 B1
(45) Date of Patent: Dec. 25, 2012

(54) SYSTEM FOR COVERING A CAMPER

(76) Inventor: Mark Belden, Ocklawaha, FL (US)

( * ) Notice: Subject to any disclaimer, the term of this patent is extended or adjusted under 35 U.S.C. 154(b) by 37 days.

(21) Appl. No.: 13/034,557

(22) Filed: Feb. 24, 2011

(51) Int. Cl.
*E04H 15/06* (2006.01)

(52) U.S. Cl. ..... 135/88.06; 135/137

(58) Field of Classification Search ..... 135/88.06, 135/132, 137, 138
See application file for complete search history.

(56) References Cited

U.S. PATENT DOCUMENTS

| | | | | |
|---|---|---|---|---|
| 2,798,501 | A * | 7/1957 | Oliver | 135/134 |
| 2,856,942 | A * | 10/1958 | Scott | 135/132 |
| 3,036,583 | A * | 5/1962 | Miller | 135/132 |
| 4,228,622 | A | 10/1980 | Tisma | |
| 4,605,030 | A * | 8/1986 | Johnson | 135/88.06 |
| 4,834,128 | A | 5/1989 | Burgess | |
| 4,886,083 | A | 12/1989 | Gamache | |
| 5,076,174 | A | 12/1991 | Martin | |
| 5,094,257 | A | 3/1992 | Wilson et al. | |
| 5,241,977 | A * | 9/1993 | Flores et al. | 135/88.06 |
| 5,501,502 | A | 3/1996 | Wang | |
| 5,740,826 | A * | 4/1998 | Nevin et al. | 135/88.06 |
| 5,941,593 | A * | 8/1999 | McCann | 296/136.1 |
| 6,276,381 | B1 * | 8/2001 | O'Brien | 135/87 |
| 7,546,844 | B2 * | 6/2009 | Al-Mutairi | 135/88.06 |
| 7,604,016 | B2 | 10/2009 | Songest | |
| 7,640,942 | B2 * | 1/2010 | Chu | 135/132 |
| 2006/0054208 | A1 * | 3/2006 | Romano | 135/132 |
| 2010/0037811 | A1 | 2/2010 | Grant | |

* cited by examiner

*Primary Examiner* — Noah Chandler Hawk

(57) ABSTRACT

A camper cover is heavy and it is generally difficult to drape the cover over a camper. The present invention features a camper system comprising swinging poles to facilitate the draping of a camper with a camper cover.

7 Claims, 8 Drawing Sheets

FRONT VIEW

TOP VIEW

SYSTEM FOR COVERING A CAMPER

BACKGROUND OF THE INVENTION

A camper cover is heavy and it is generally difficult to drape the cover over a camper. The present invention features a camper system comprising swinging poles to facilitate the draping of a camper with a camper cover.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
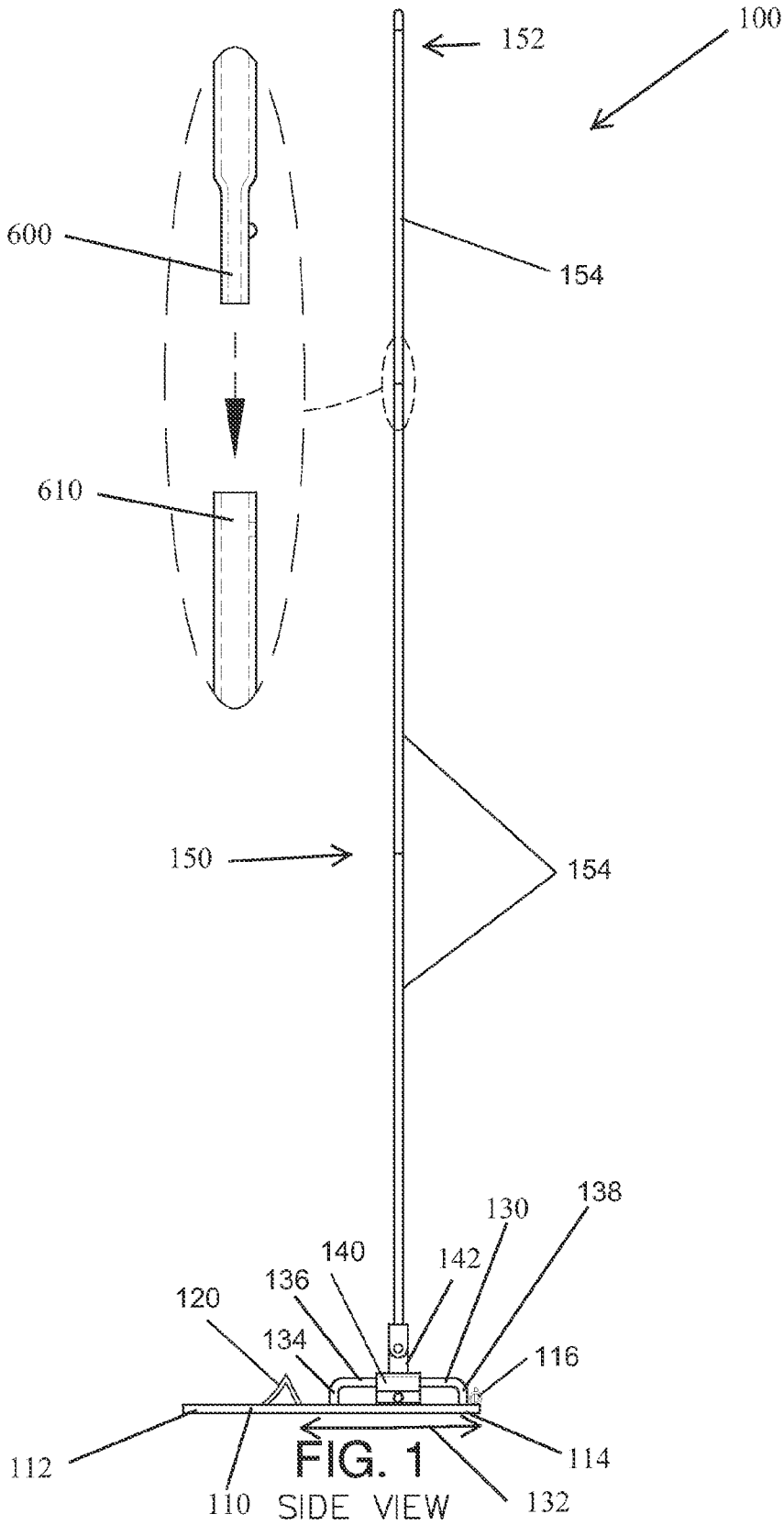
FIG. 1 shows a side view of the system.
Figure 1A:
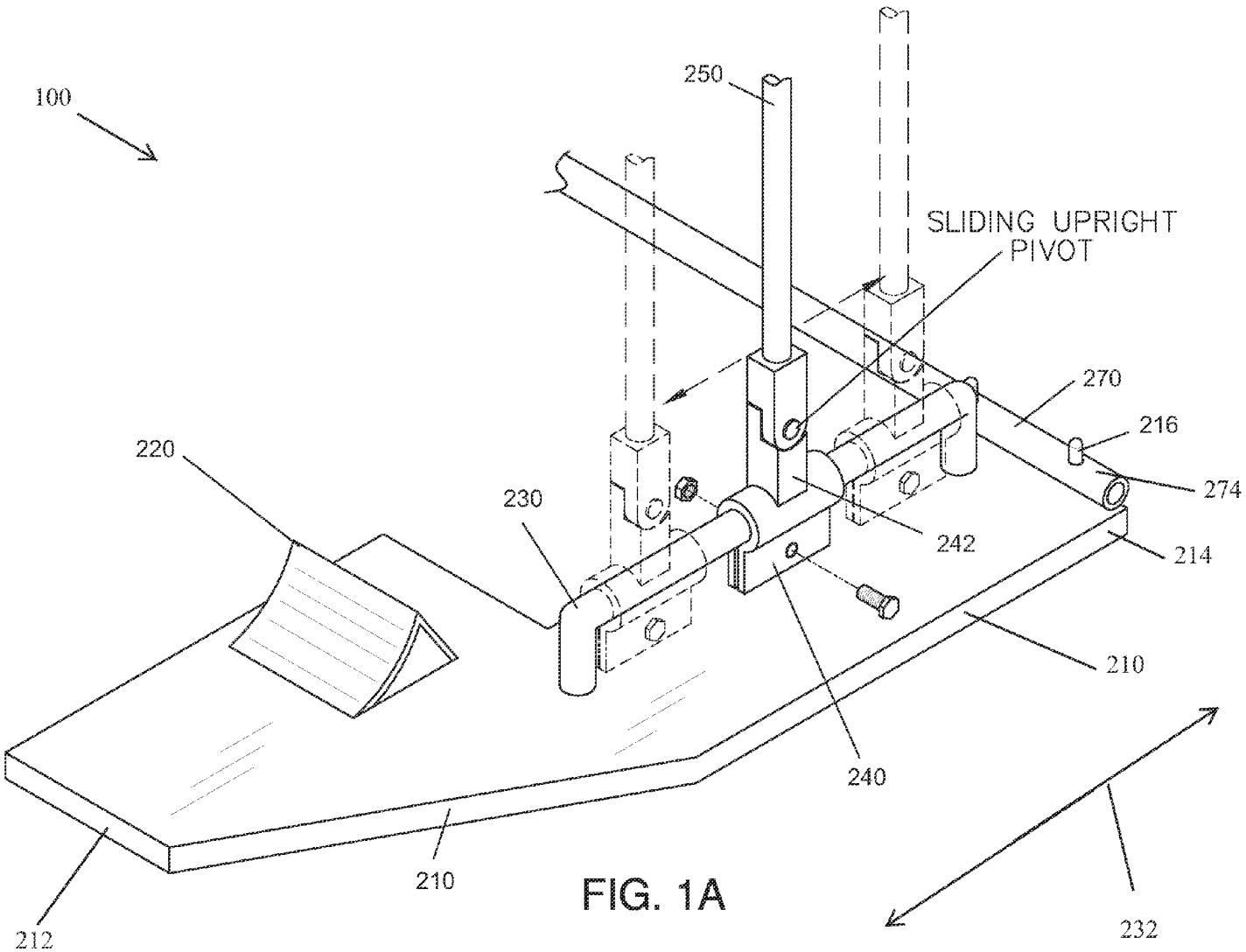
FIG. 1A shows a perspective view of the system, in particular the second plate and assemblies thereon.
Figure 2:
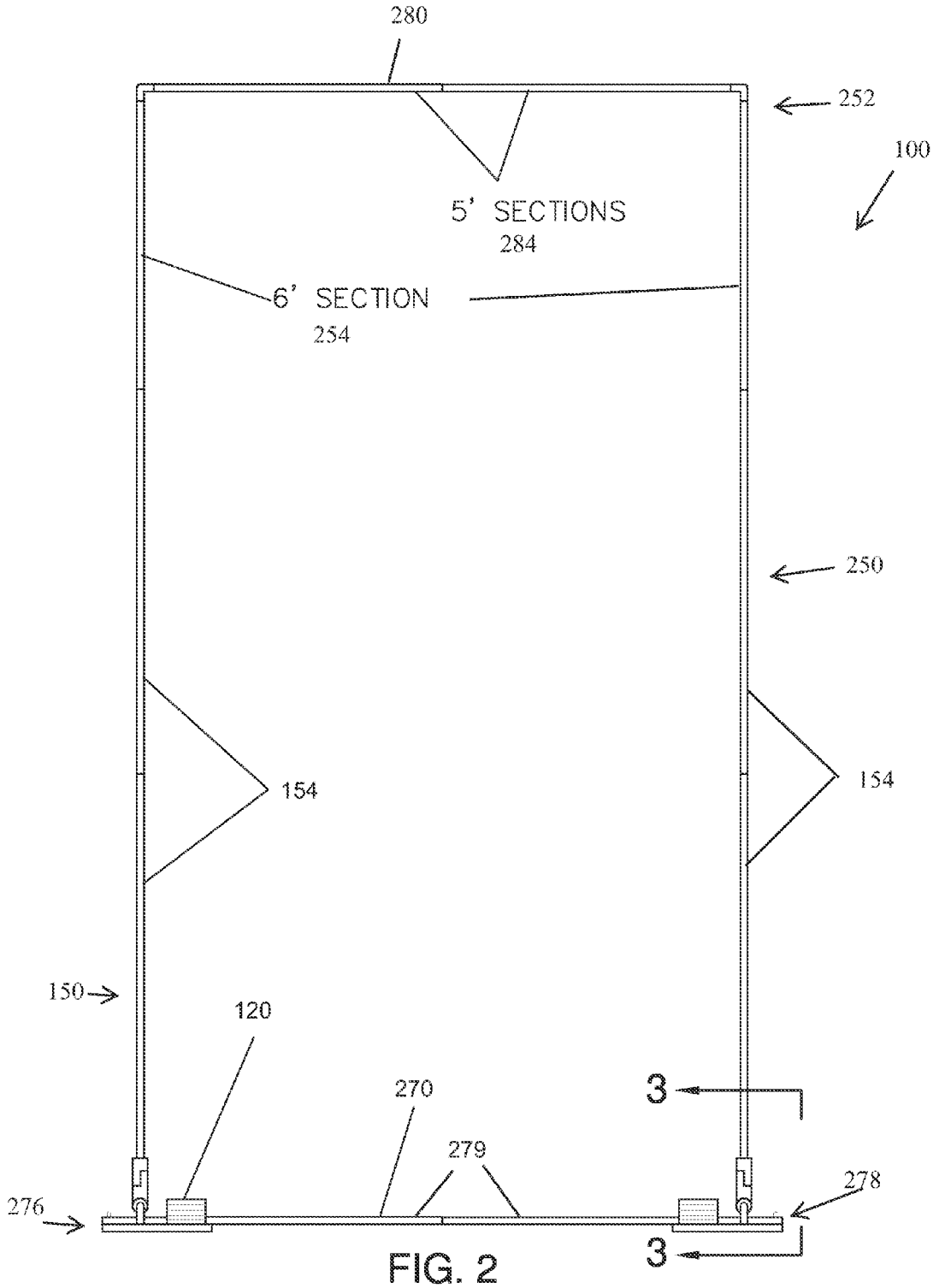
FIG. 2 shows a front view.
Figure 3:
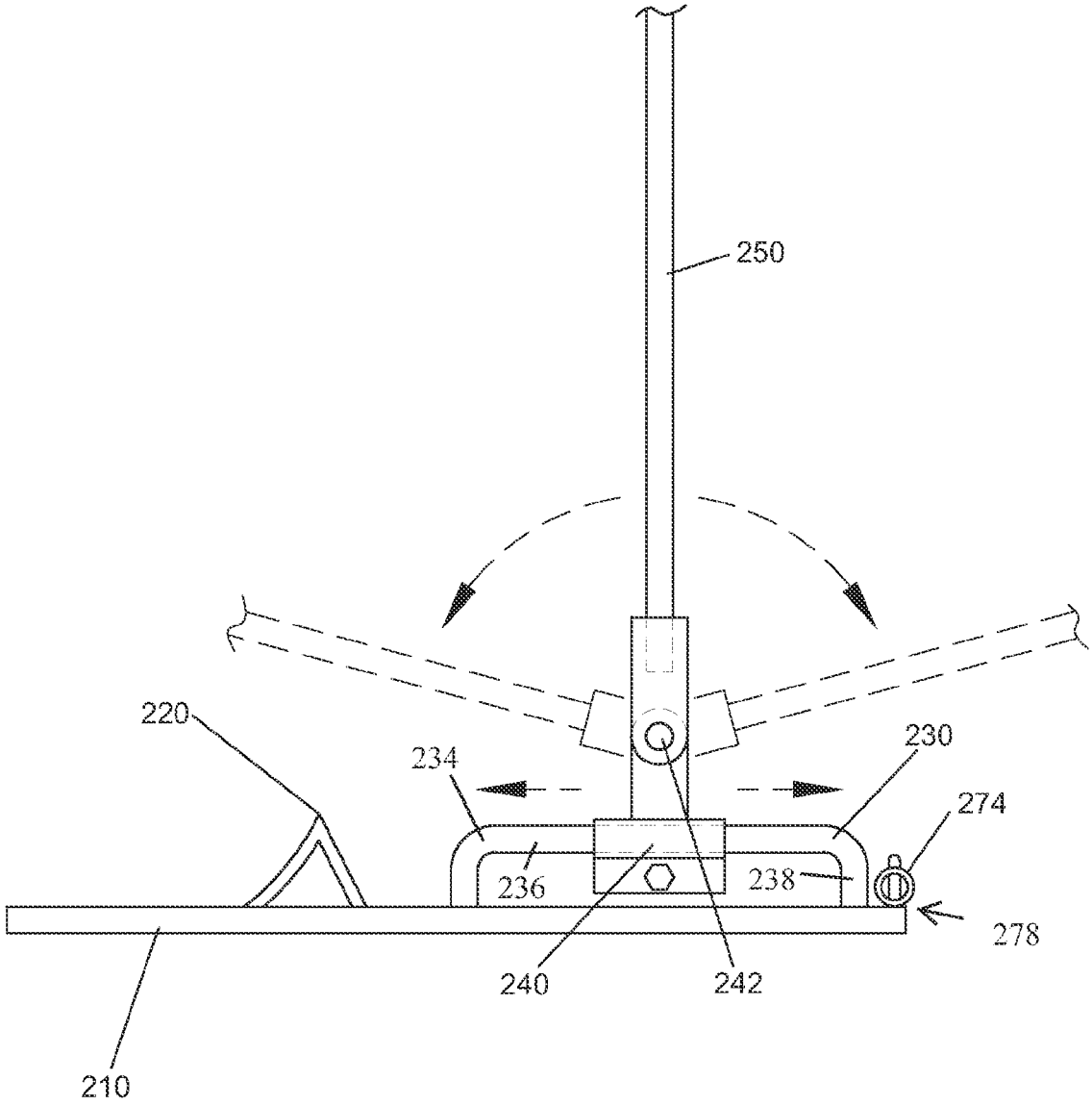
FIG. 3 shows a side view of the system.
Figure 4:
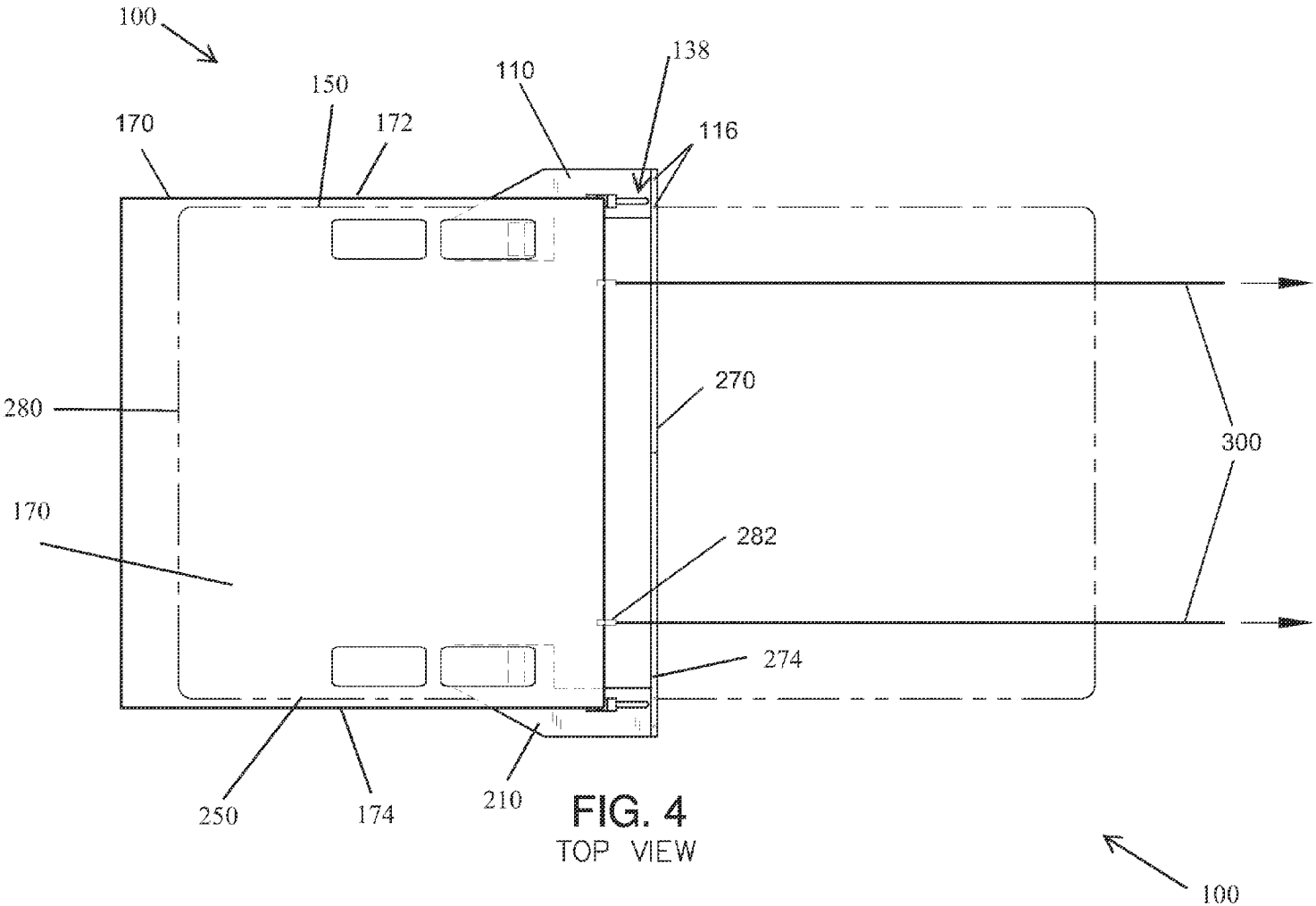
FIG. 4 shows a top view of the system.
Figure 5:
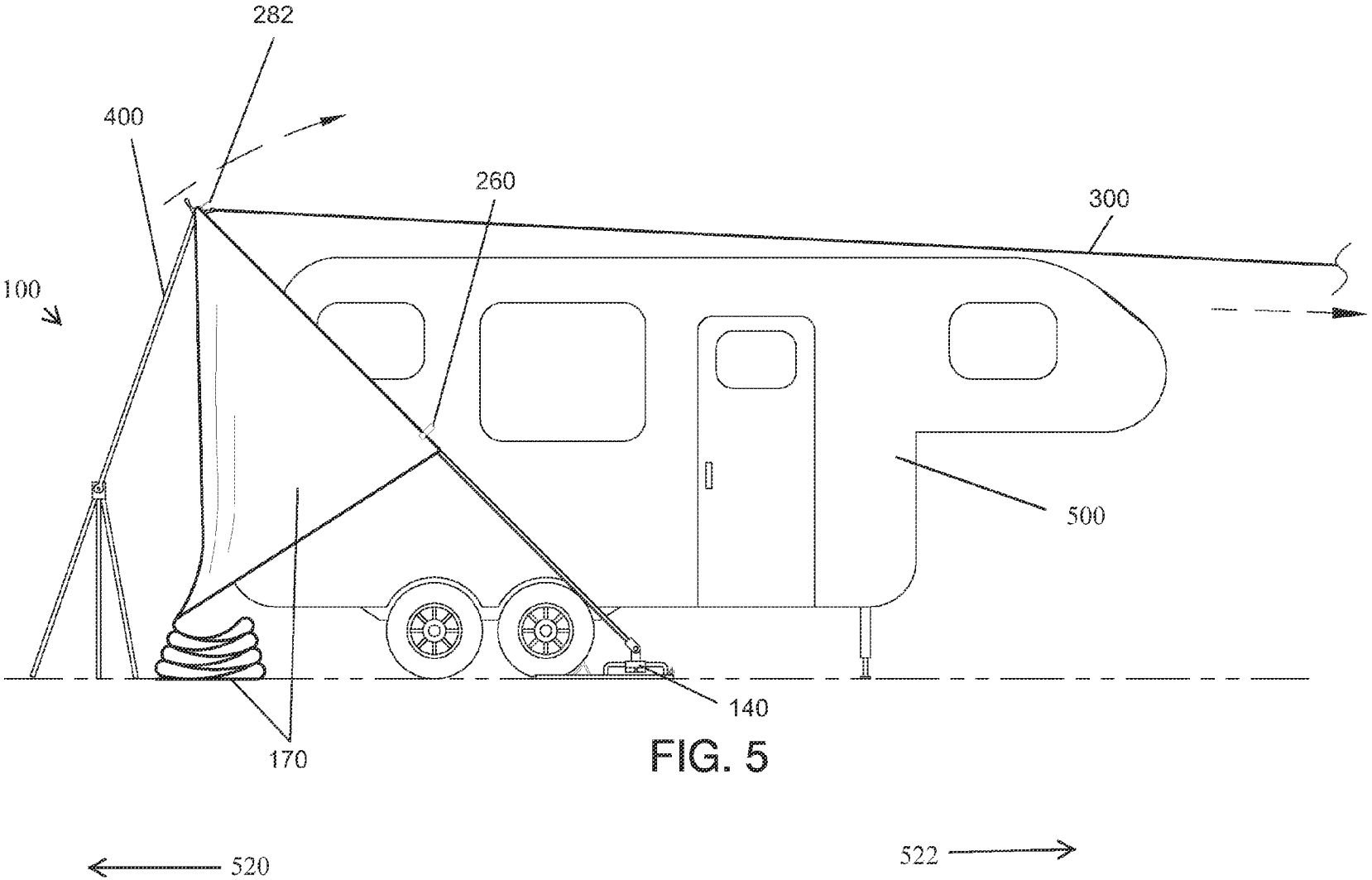
FIG. 5 shows a side view of the system wherein the camper cover is clamped to the first and second lift poles and linking bar. The first and second lift poles are at angled toward the first end of the camper.
Figure 6:
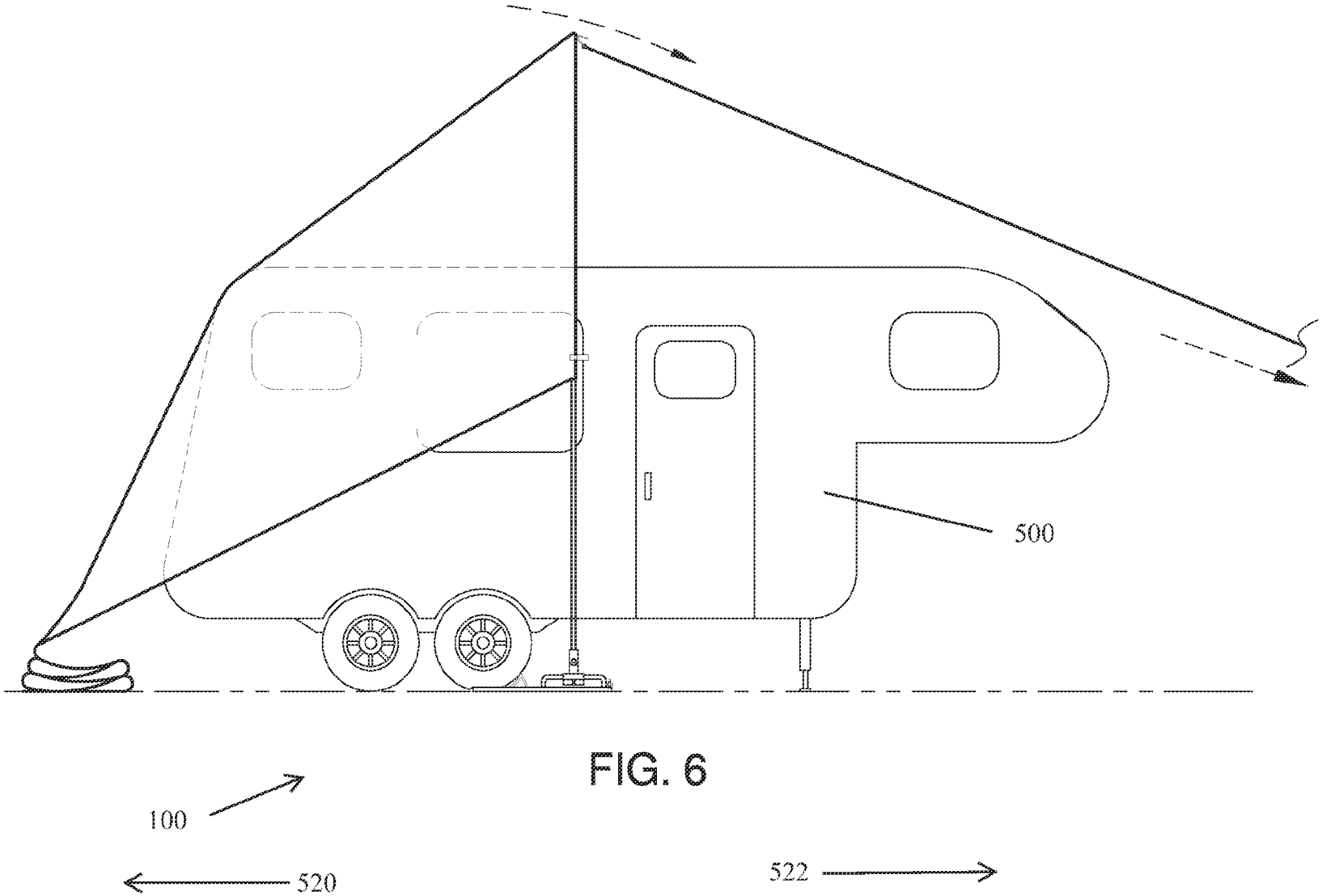
FIG. 6 shows a side view of the system wherein the camper cover is clamped to the first and second lift poles and linking bar. The first and second lift poles are pulled away from the first end of the camper by a rope.
Figure 7:
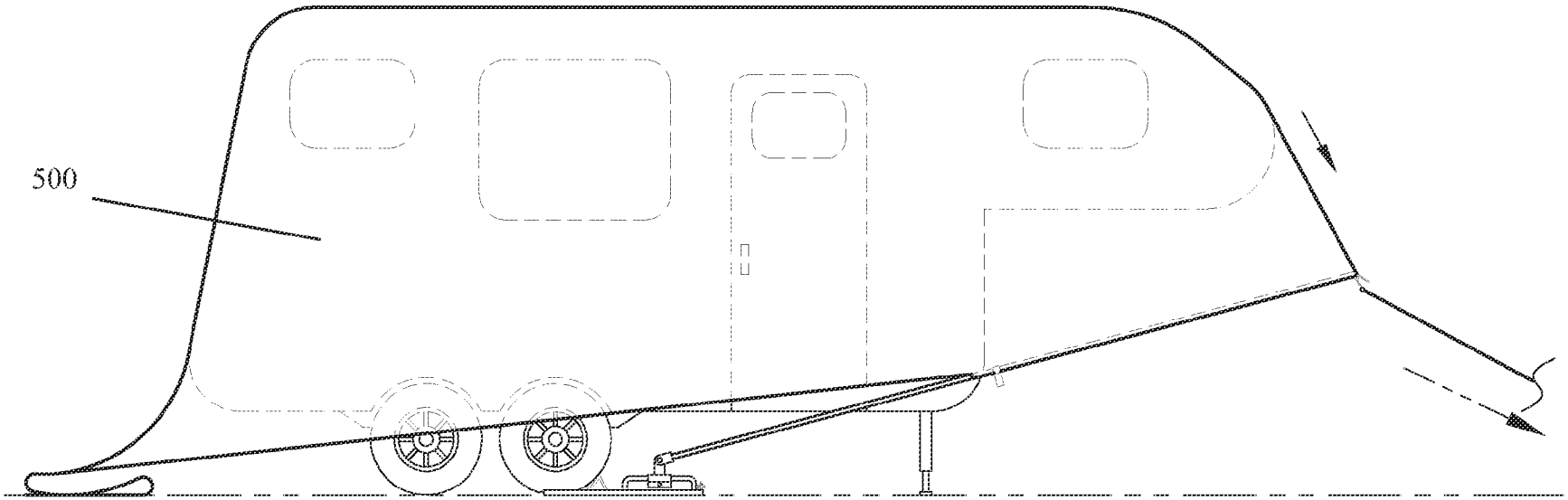
FIG. 7 shows a side view of the system wherein the camper cover is clamped to the first and second lift poles and linking bar. The first and second lift poles are pulled toward the second end of the camper and the draping of the camper by the camper cover is complete.

Referring now to FIG. 1-7, the present invention features a system 100 for covering a camper 500. In some embodiments, the system comprises a first base plate 110 having a first front base end 112 and a first rear base end 114, a first wheel chock 120 disposed at the first front base end 112, a first bracket 130 disposed along a length 132 of the first base plate 110, a first screw clamp 140 embracing the first bracket 130, a first tee 142 fixably disposed on the first screw clamp 140, a first lift pole 150 pivotably attached to the first tee 142. In some embodiments, the first lift pole 150 has a first lift pole upper end 152, a first side clamp 160 disposed on the first lift pole 150 for clamping a first side section 172 of a camper cover 170 to the first lift pole 150. In some embodiments, the first screw clamp 140 can be secured at a position near a front bracket end 134, near a middle section of the bracket 136 (as shown in FIG. 3) or near a rear bracket end 138. In some embodiments, a first pin 116 is disposed at the first rear base end 114.

The system further comprises a second base plate 210 having a second front base end 212 and a second rear base end 214, a second wheel chock 220 disposed at the second front base end 210, a second bracket 230 disposed along the length 232 of the second base plate 210, a second screw clamp 240 embracing the second bracket 230, a second tee 242 fixably disposed on the second screw clamp 240, a second lift pole 250 pivotably attached to the second tee 242. In some embodiments, the second lift pole 250 has a second lift pole upper end 252, and a second side clamp 260 disposed on the second lift pole 250 for clamping a second side section 174 of the camper cover 170 to the second lift pole 250. In some embodiments, the second screw clamp 240 can be secured at a position near a front bracket end 234, near a middle section of the bracket 236 or near a rear bracket end 238. Due to the difference in length of campers the second screw clamp 240 allows the base plate 210 to be at the center point of the camper. In some embodiments, a second pin 216 is disposed at the second rear base end 214.

In some embodiments, the system further comprises a cross support 270 having a first cross support end 272 and a second cross support end 274. In some embodiments, the first cross support end 272 comprises a first aperture 276 and the second cross support end comprises a second aperture 278, wherein the first base plate 110 and the second base plate 210 are placed side by side to allow the first aperture 276 of the cross support 270 to fit over the first pin 116 and the second aperture 278 of the cross support 270 to fit over the second pin 216 of the first and second base plates, respectively, to lock the first and second base plates together relative to each other. In some embodiments, the system further comprises a linking bar 280 connecting the upper end of the first lift pole 152 and the upper end of the second lift pole 252. In some embodiments, a top clamp 282 is disposed on the linking bar 280 for clamping a top section 176 of the camper cover 170 to the linking bar 280.

To cover the camper 500 with the camper cover 170, the camper 500 is parked with its wheels 510 rested on the first 110 and second 210 base plates and up against the first 120 and second 220 wheel chocks. The first side clamp 160, top clamp 282 and second side clamp 260 are used to clamp onto a camper cover 170 at the first side section 172, top section 176 and second side section 174 of the camper cover 170, respectively. To start, the first 150 and second 250 lift poles are angled toward a first end of the camper 520, then the first 150 and second 250 lift poles are swung toward the second end 522 of the camper and causing the camper cover 170 to drape over the camper 500.

In some embodiments, the first lift pole 150 comprises multiple connecting sections 154. In some embodiments, the second lift pole 250 comprises multiple connecting sections 154. In some embodiments, the cross support 270 comprises multiple connecting sections 279. In some embodiments, the linking bar 280 comprises multiple connecting sections 284. In some embodiments, the connection sections are tubes comprising a male end and a female end, where a male end 600 of one section can be fitted with a female end 610 of another section to form a longer tube, see FIG. 1 insert for example.

In some embodiments, a rope 300 is attached to the linking bar 280 to swing the first 150 and second lift pole 250 from the first end 520 of the camper toward the second end 522. In some embodiments, a launching pole 400 is used to push and lift the linking bar from the first end 520 of the camper toward the second end 522, see FIG. 5 for example.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A system (100) for covering a camper (500), the system comprising:

(a) a first base plate (110) having a first front base end (112) and a first rear base end (114);

(b) a first wheel chock (120) disposed at the first front base end (112);

(c) a first bracket (130) disposed along a length (132) of the first base plate (110), wherein the first bracket comprises a front end (134), a rear end (138) and a middle section (136) disposed between the front end (134) and rear end (138);

(d) a first screw clamp (140) embracing the first bracket (130) on the middle section (136), wherein the screw clap (140) is slideably securable to any point along the middle section (136), wherein the first bracket (130) provides a linear motion of the first screw clap (140) along the first base plate (110) in the direction between the first front base end (112) and first rear base end (114), a first tee (142) fixably disposed on the first screw clamp (140), a first lift pole (150) pivotably attached to the first tee (142), the first lift pole (150) has a first lift pole upper end (152), a first side clamp (160) disposed on the first lift pole (150) for clamping a first side section (172) of a camper cover (170) to the first lift pole (150); wherein the first screw clamp (140) can be secured at a position near a front bracket end (134), near a middle section of the bracket (136) or near a rear bracket end (138);

(e) a first pin (116) disposed at the first rear base end (114);

(f) a second base plate (210) having a second front base end (212) and a second rear base end (214);

(g) a second wheel chock (220) disposed at the second front base end (210);

(h) a second bracket (230) disposed along the length (232) of the second base plate (210), wherein the second bracket comprises a front end (234), a rear end (238) and a middle section (236) disposed between the front end (234) and rear end (238);

(i) a second screw clamp (240) embracing the second bracket (230) on the middle section (236), wherein the screw clap (240) is slideably securable to any point along the middle section (236), wherein the second bracket (230) provides a linear motion of the second screw clap (240) along the second base plate (210) in the direction between the second front base end (212) and second rear base end (214), a second tee (242) fixably disposed on the second screw clamp (240), a second lift pole (250) pivotably attached to the second tee (242), the second lift pole (250) has a second lift pole upper end (252), a second side clamp (260) disposed on the second lift pole (250) for clamping a second side section (174) of the camper cover (170) to the second lift pole (250); wherein the second screw clamp (240) can be secured at a position near a front bracket end (234), near a middle section of the bracket (236) or near a rear bracket end (238);

(j) a second pin (216) disposed at the second rear base end (214);

(k) a cross support (270) having a first cross support end (272) and a second cross support end (274), the first cross support end (272) comprises a first aperture (276) and the second cross support end comprises a second aperture (278), wherein the first base plate (110) and the second base plate (210) are placed side by side to allow the first aperture (276) of the cross support (270) to fit over the first pin (116) and the second aperture (278) of the cross support (270) to fit over the second pin (216) of the first and second base plates, respectively, to lock the first and second base plates together relative to each other;

(l) a linking bar (280) connecting the upper end of the first lift pole (152) and the upper end of the second lift pole (252); a top clamp (282) disposed on the linking bar (280) for clamping a top section (176) of the camper cover (170) to the linking bar (280);

wherein to cover the camper (500) with the camper cover (170), the camper (500) is parked with its wheels (510) rested on the first (110) and second (210) base plates the first (120) and second (220) wheel chocks, the first side clamp (160), top clamp (282) and second side clamp (260) are used to clamp onto a camper cover (170) at the first side section (172), top section (176) and second side section (174) of the camper cover (170), respectively, when the first (150) and second (250) lift poles are angled toward a first end of the camper (520), then the first (150) and second (250) lift poles are swung toward the second end (522) of the camper and causing the camper cover (170) to drape over the camper (500).

2. The system for covering a camper of claim 1 wherein the first lift pole (150) comprises multiple connecting sections (154).

3. The system for covering a camper of claim 1 wherein the second lift pole (250) comprises multiple connecting sections (154).

4. The system for covering a camper of claim 1 wherein the cross support (270) comprises multiple connecting sections (279).

5. The system for covering a camper of claim 1 wherein the linking bar (280) comprises multiple connecting sections (284).

6. The system for covering a camper of claim 1 wherein a rope (300) is attached to the linking bar (280) to swing the first (150) and second lift pole (250) from the first end (520) of the camper toward the second end (522).

7. The system for covering a camper of claim 1 wherein a launching pole (400) is used to push and lift the linking bar from the first end (520) of the camper toward the second end (522).

* * * * *